US011506023B2

(12) United States Patent
Nafa

(10) Patent No.: US 11,506,023 B2
(45) Date of Patent: Nov. 22, 2022

(54) WELLHEAD SPILL PREVENTION APPARATUSES AND METHODS

(71) Applicant: Saudi Arabian Oil Company, Dhahran (SA)

(72) Inventor: Hamed Nafa, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/165,071

(22) Filed: Feb. 2, 2021

(65) Prior Publication Data

US 2022/0243563 A1 Aug. 4, 2022

(51) Int. Cl.
*E21B 41/00* (2006.01)

(52) U.S. Cl.
CPC ..... *E21B 41/0021* (2013.01)

(58) Field of Classification Search
CPC ..... E21B 41/0021
USPC ..... 166/81.1
See application file for complete search history.

(56) References Cited

U.S. PATENT DOCUMENTS 4,696,330 A 9/1987 Raudman et al.
5,228,506 A * 7/1993 Pearce ..... E21B 33/08 166/81.1
5,377,748 A 1/1995 Gayaut
5,477,920 A * 12/1995 Simmons ..... E21B 33/08 166/81.1
5,634,485 A 6/1997 Holtby
5,937,947 A 8/1999 Holtby
6,286,593 B1 * 9/2001 Holtby ..... E21B 33/03 137/15.08
6,415,861 B1 * 7/2002 Harrison, Jr. ..... E21B 33/08 166/81.1
7,987,904 B1 * 8/2011 Rose ..... E21B 33/03 52/220.8
9,453,392 B1 * 9/2016 Marchiori ..... E21B 21/01
10,605,031 B2 3/2020 Stierwalt
2007/0169931 A1 * 7/2007 Holthe ..... E21B 43/127 166/81.1

(Continued)

FOREIGN PATENT DOCUMENTS

CA 2743825 A1 2/2012
CN 201963246 U 9/2011

(Continued)

OTHER PUBLICATIONS

AbsorbentsOnline.com; "Oil Wellhead Berms" available as of Oct. 7, 2020 at: https://www.absorbentsonline.com/oil-wellhead-bern.htm; pp. 1-5.

(Continued)

*Primary Examiner* — Matthew R Buck
*Assistant Examiner* — Patrick F Lambe
(74) *Attorney, Agent, or Firm* — Bracewell LLP; Constance G. Rhebergen; Keith R. Derrington

(57) ABSTRACT

Apparatus and method for wellhead spill prevention are disclosed. The wellhead spill prevention apparatus includes a clamp-on portion that is configured to be clamped onto a tubular member of the wellhead, a crude oil reservoir for collecting oil coming from the wellhead, and a slanted wall slanting downwards and attached to the clamp-on portion on top and the crude oil reservoir at the bottom, thereby enabling oil coming from the wellhead to collect in the crude oil reservoir.

18 Claims, 3 Drawing Sheets

(56) References Cited

U.S. PATENT DOCUMENTS

2017/0022787 A1 1/2017 Holtby

FOREIGN PATENT DOCUMENTS

| | | | |
|---|---|---|---|
| CN | 105317403 | A | 2/2016 |
| CN | 206071520 | U | 4/2017 |
| CN | 110617023 | A | 12/2019 |
| CN | 210068061 | U | 2/2020 |

OTHER PUBLICATIONS

Ultratech International Inc.; "Ultra-Wellhead Berm" available as of Oct. 7, 2020 at: https://www.spillcontainment.com/products/wellhead-berm/; pp. 1-7.

* cited by examiner

WELLHEAD SPILL PREVENTION APPARATUSES AND METHODS

TECHNICAL FIELD

Embodiments of the present invention relate to a system and method for catching waste fluids leaking from a wellhead. More particularly, embodiments of the present invention relate to a fluid-containing basin that encircle a tubular member of the wellhead for forming an annular oil catch pan.

BACKGROUND

A blowout preventer drip tray, generally called a "bop tray," is a liquid containment tray that has been used for several decades in oilfield drilling, production, and workout. Bop trays are mounted around the wellhead stem pipe beneath the blowout preventers. Largely for environmental purposes, they function to catch and contain potentially hazardous oilfield liquids spilling from the wellhead. As is fairly well-known, liquid spills on the ground around a wellhead can be expensive to clean up.

Structurally, the basic part of a conventional bop tray is a circular pan, with an up-turned circumferential rim to help contain the captured liquids. The trays typically have a central hole through which the wellhead stem pipe extends, and they often mount above or below one or more wellhead collars and/or flanges that are connected to the wellhead stem pipe. One popular bop tray is marketed as the "Katch Kan," versions of which have been commercially available since the early-to-mid 1990's.

For ease of installation, conventional bop trays come in two, substantially-symmetrical, semicircular halves. The two halves are positioned on horizontally opposite sides of the wellhead and then bolted together around the wellhead to catch and contain liquids. Such conventional bop tray designs serve the basic functions reasonably well, but it is accepted that it takes up to an hour or so to properly install conventional bop trays. Not only is there a labor and work stoppage expense associated with the amount of time required, but usually the need to catch the liquids is imminent when the bop tray is being installed, which increases the risk of a worsening clean-up problem while the crew is installing the bop tray.

Additionally, currently available containment trays suffer from a significant limitation in that the amount of pressure which may be exerted on the combined halves and on the wellhead section enclosed is limited by the bolt type fasteners used to secure the two halves together.

The liquids caught by bop trays might include everything from leaking oil to cleaning solutions, as well as drilling mud, brine, and other hydraulic fluids, most of which are both potentially hazardous as well as costly. Remediation/clean-up expenses and environmental impacts of inadequate containment of the liquids can be enormous. Moreover, when the spilled liquids are valuable, bop trays also allow for capture, sale and/or re-use of the liquids that leak from or are applied to the wellhead. Only a little liquid might spill during each drill string connection, but the cumulative costs of spilled liquids can be substantial over the duration of a drilling operation. Accordingly, many bop trays are provided with slots or holes to accommodate surrounding structures, such as hoses to recirculate the liquids or to direct the captured liquids into appropriate tanks.

Irrespective of the detailed approaches of the prior art, there remains a long-felt need to better capture, contain and manage liquids spilling around a wellhead. Moreover, with bop trays specifically, there has been a long-felt need for a bop tray that is both highly functional and dependable while also being faster and easier to install and use, yet oilfield tool manufacturers and support services have not been able to adequately address such needs.

SUMMARY

Accordingly, example embodiments relate to an external clamp-on round tray (container) that will prevent oil from seeping into a wellhead and valves containing crude oil from coming out of the wellhead. The clamp will provide flexibility to be installed on any size of wellhead without the need for any fabrication or compromise to the integrity and the design of the wellhead. The installed container can then be drained in an environmentally friendly manner without any spill in the area.

That said, a basic objective of the present invention is to improve over the prior art. To that end, it is an object of the present invention to provide or enable an annular drip tray in the field for reducing the quantity of potentially hazardous fluids leaking on the ground. Another object of the present invention is to enable cost-effective reduction of liquid loss and environmental contamination from wellheads and related operations. Other objects are to minimize direct and indirect costs and to reduce the risk of injury to oilfield personnel.

It is also an object of the invention to provide a fast and effective configuration for a liquid containment tray that allows rapid installation around wellhead structures at locations where spilled liquids can be efficiently captured. It is also an object to enable installation of bop trays with fewer personnel than with alternative solutions.

Other objects of the invention include the provision of an annular drip tray for capture of liquids above the high drill of a drilling rig blowout preventer, both for environmental containment and for keeping the high drill relatively clean during drilling operations. Related objects include the enablement of a reliable system for rapid installation of wellhead drip trays and, more particularly, for rapid installation of an effective bop tray with only one or fewer latches or the like. Other objects include the provision of solutions that are safe, effective, and environmentally friendly.

One example embodiment is a wellhead spill prevention apparatus including a clamp-on portion that is configured to be clamped onto a tubular member of the wellhead, a crude oil reservoir for collecting oil coming from the wellhead, and a slanted wall slanting downwards and attached to the clamp-on portion on top and the crude oil reservoir at the bottom, thereby enabling oil coming from the wellhead to collect in the crude oil reservoir. The slanted wall has a frusto-conical structure having a first diameter and a second diameter, the second diameter being larger than the first diameter. The first diameter of the frusto-conical structure is attached or welded to the clamp-on portion and the second diameter of the frusto-conical structure is attached or welded to the crude oil reservoir. The slanted wall may include a plurality of panels adjoining each other, thereby forming a generally frusto-conical structure having a first diameter and a second diameter, the second diameter being larger than the first diameter.

The apparatus may include two or more segments, each including a portion of the clamp-on portion, the crude oil reservoir, and the slanted wall. The two or more segments are held together by means of two or more couplers. The two or more couplers each include a pin inserted into an eyelet formed on each of the segments, or the two or more couplers may be installed on the body of the apparatus so as to couple the two or more segments together.

The clamp-on portion is configured to be clamped onto a portion of the wellhead when a lubricator is disconnected from a crown valve of the wellhead assembly, or when a wellhead pressure is bled off or when a wireline or slickline job is completed. The crude oil reservoir includes an annular pan or tray having a floor, a side wall, and a generally circular shape. The side wall is either vertical or formed at an angle relative to the floor of the tray.

The clamp-on portion, the crude oil reservoir, and the slanted wall are made of the same material or different materials. In one embodiment, the clamp-on portion, the crude oil reservoir, and the slanted wall each include a light weight material or a material selected from the group consisting of a polymer, stainless steel, and aluminum. Alternatively, they can be can be made from enforced rubber material such as the one used to make tires. This provides light weight, flexibility, and makes it easy to store the apparatus anywhere, even under the seat of a well services pickup.

Another embodiment is a method for wellhead spill prevention. The method includes clamping on a spill prevention apparatus to a tubular member of the wellhead, the spill prevention apparatus including a clamp-on portion that is configured to be clamped onto the tubular member of the wellhead, a crude oil reservoir for collecting oil coming from the wellhead; and a slanted wall slanting downwards and attached to the clamp-on portion on top and the crude oil reservoir at the bottom, thereby enabling oil coming from the wellhead to collect in the crude oil reservoir.

BRIEF DESCRIPTION OF THE DRAWINGS

So that the manner in which the features, advantages and objects of the example embodiments, as well as others which may become apparent, are attained and can be understood in more detail, more particular description of the example embodiments briefly summarized above may be had by reference to the embodiment which is illustrated in the appended drawings, which drawings form a part of this specification. It is to be noted, however, that the drawings illustrate only example embodiments and is therefore not to be considered limiting of its scope as the invention may admit to other equally effective embodiments.

DETAILED DESCRIPTION

The methods and systems of the present disclosure will now be described more fully with reference to the accompanying drawings in which embodiments are shown. The methods and systems of the present disclosure may be in many different forms and should not be construed as limited to the illustrated embodiments set forth in this disclosure; rather, these embodiments are provided so that this disclosure will be thorough and complete, and will fully convey its scope to those skilled in the art. Like numbers refer to like elements throughout.

Figure 1:
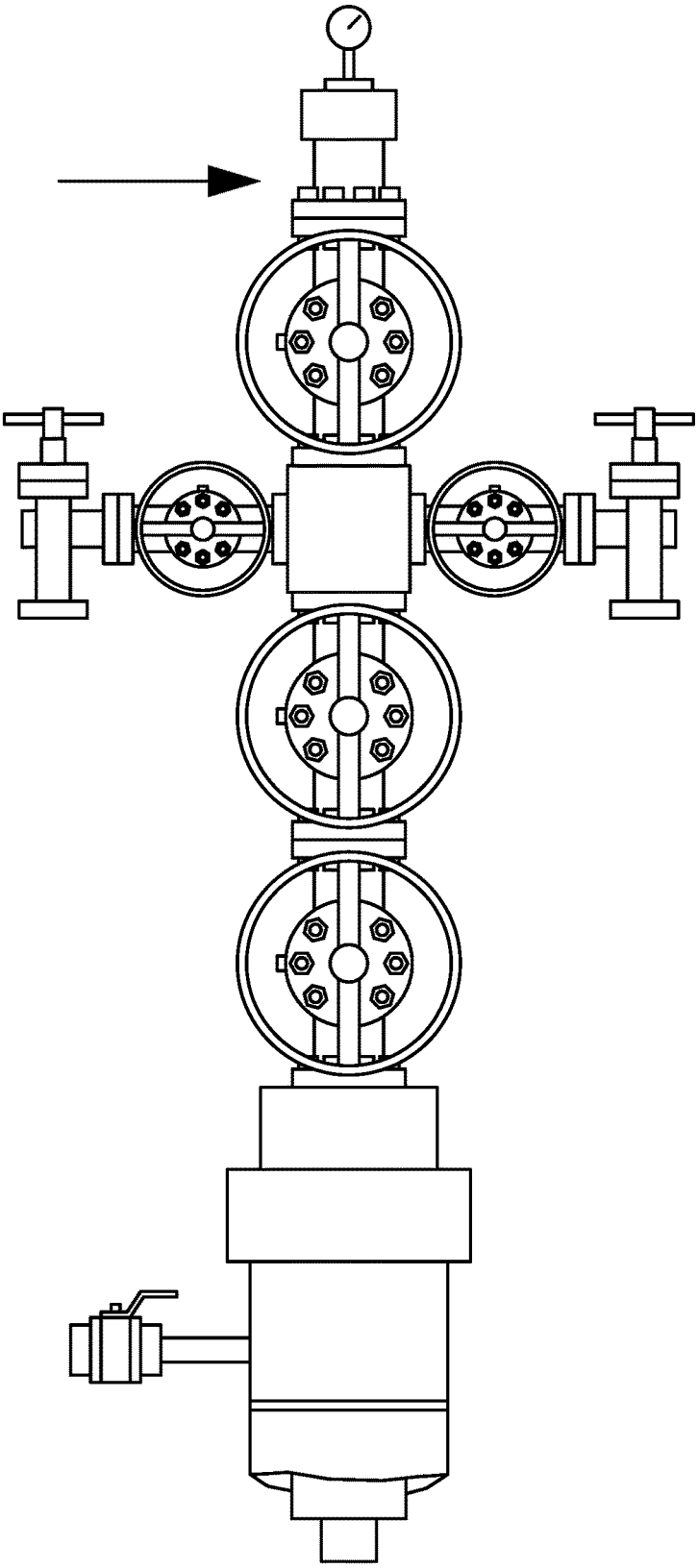
FIG. 1 is a schematic of a blowout preventer in a wellhead, according to teachings of the prior art, and a proposed location for the installation of the inventive wellhead spill prevention apparatus, according to one or more example embodiments of the disclosure.

FIG. 1 is a schematic of a blowout preventer in a wellhead, according to teachings of the prior art, and a proposed location for the installation of the inventive wellhead spill prevention apparatus, according to one or more example embodiments of the disclosure. With reference to FIG. 1, many aspects of the invention may be embodied as an annular assembly that forms a wellhead spill prevention apparatus or bop tray, and other aspects of the invention are enabled and appreciated when such a bop tray is installed and used surrounding a wellhead, preferably in a position above the high drill of the wellhead's blowout preventer.

Figure 2:
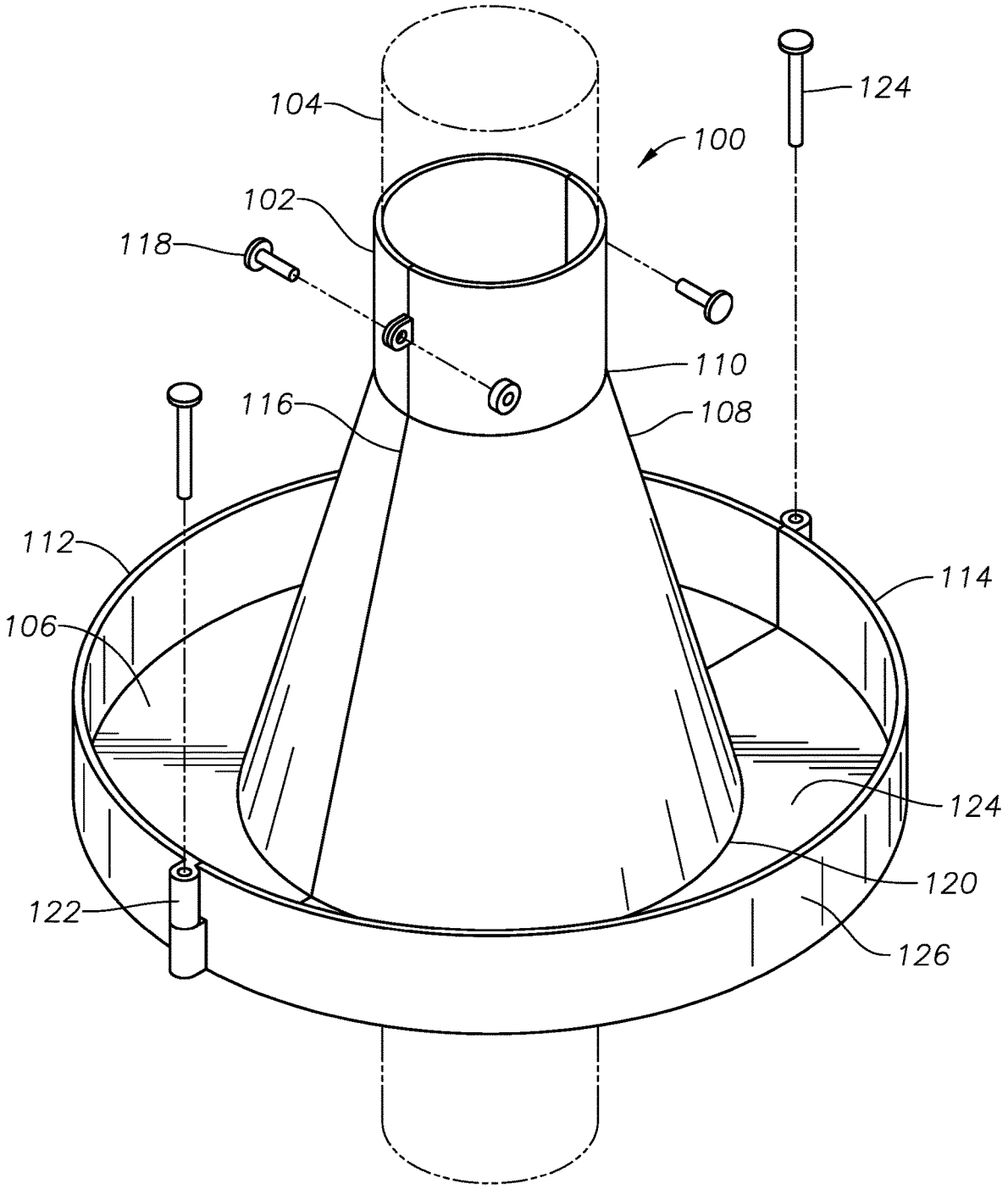
FIG. 2 is a perspective view of a wellhead spill prevention apparatus, according to one or more example embodiments of the disclosure.

FIG. 2 is a perspective view of a wellhead spill prevention apparatus 100, according to one or more example embodiments of the disclosure. The wellhead spill prevention apparatus 100 includes a clamp-on portion 102 that is configured to be clamped onto a tubular member 104 of the wellhead. The apparatus 100 further includes a crude oil reservoir 106 for collecting oil coming from the wellhead, and a slanted wall 108 slanting downwards. The slanted wall 108 is attached to the clamp-on portion 102 on top and the crude oil reservoir 106 at the bottom, thereby enabling oil coming from the wellhead to collect in the crude oil reservoir 106. The slanted wall 108 has a frusto-conical structure having a first diameter 110 and a second diameter 120. The second diameter 120 is larger than the first diameter 110, and the first diameter 110 of the frusto-conical structure is attached or welded to the clamp-on portion 102 and the second diameter 120 of the frusto-conical structure is attached or welded to the crude oil reservoir 106.

The apparatus 100 may include two or more segments 112, 114, each comprising a portion of the clamp-on portion, the crude oil reservoir, and the slanted wall. Line 116 shown in this figure indicates the point where the two segments 112 and 114 come together. The two or more segments 112, 114 can held together by means of two or more couplers 118, 122. The two or more couplers may each include a pin 124 inserted into an eyelet formed on each of the segments 112, 114, or the two or more couplers may be installed on the body of the apparatus (such that 118) so as to couple the two or more segments 112, 114 together. The segments 112, 114 of the wellhead spill prevention apparatus 100 or bop tray can be held together using couplers (40) as described in U.S. Pat. No. 6,286,593 or using couplers (48) as described in CA 2743825 A1, the entire contents of which is incorporated herein by reference. The clamp-on portion 102 may be configured to be clamped onto a portion of the wellhead when a lubricator is disconnected from a crown valve of the wellhead assembly, or when a wellhead pressure is bled off or when a wireline or slickline job is completed.

The crude oil reservoir 106 may include an annular pan or tray having a floor 124, a side wall 126, and a generally circular shape. The side wall 126 is either vertical or formed at an angle relative to the floor 124 of the tray. The clamp-on portion 102, the crude oil reservoir 106, and the slanted wall 108 may be made of the same material or different materials. In one embodiment, the clamp-on portion 102, the crude oil reservoir 106, and the slanted wall 108 each are made of a light weight material or a material selected from the group consisting of a polymer, stainless steel, and aluminum. Alternatively, they can be can be made from enforced rubber material such as the one used to make tires. This provides light weight, flexibility, and makes it easy to store the apparatus anywhere, even under the seat of a well services pickup.

At least one of the eyelets on one of the segments also extends circumferentially to overlap the at least one eyelet on the other segment permitting passage of the pin therethrough. In an embodiment wherein the pin and eyelet arrangement has one eyelet on each section adjacent each abutment, the one eyelet on each section can be positioned adjacent a top of the exterior wall. In an embodiment as shown in FIG. 2, each pin and eyelet arrangement comprises a set of eyelets. Each set of eyelets is formed of two or more eyelets, each of which extends radially outwardly from the exterior sidewall. Further, the two or more eyelets of at least one of the sets of eyelets at each abutment extends circumferentially for overlapping the two or more eyelets of the adjacent set of eyelets. The pin passes through all of the aligned eyelets at each abutment for detachably securing the abutted sections together. Removal of the pins from the aligned eyelets permits the sections to be separated. Removal of the pin from one of the aligned sets of eyelets at one abutment permits the sections to be separated, and pivoted or hinged about the other pin and aligned sets of eyelets at the other abutment. As shown a first eyelet of the two or more eyelets of each set is positioned adjacent a top of the exterior wall and a second eyelet of the two or more eyelets is aligned therebelow. The one or more couplers may be of any suitable form that applies tension to hold the sections of the annular pans together, as for example a cord, strap and buckle, or nut and bolt.

Referring to FIG. 1, several two part quick release couplers are provided, which are generally identified by reference numeral 118. A first portion of each two part quick release coupler 118 is along first mating edge. A second portion of each two part quick release coupler 118 is along second mating edge. The liquid retaining cavity of reservoir 106 has at least one drainage aperture or outlet (not shown). Each section of the oil catch pan can have one or more drainage outlets. In one embodiment, the one or more drainage outlets can be on the bottom, while in another embodiment (not shown) the one or more drainage outlets can be on the exterior sidewall adjacent the bottom.

Another embodiment is a method for wellhead spill prevention. The method includes clamping on a spill prevention apparatus 100 to a tubular member 104 of the wellhead. The spill prevention apparatus 100 includes a clamp-on portion 102 that is configured to be clamped onto the tubular member 104 of the wellhead, a crude oil reservoir 106 for collecting oil coming from the wellhead, and a slanted wall 108 slanting downwards from the clamp-on portion. The slanted wall 108 is attached to the clamp-on portion 102 on top and the crude oil reservoir 106 at the bottom, thereby enabling oil coming from the wellhead to collect in the crude oil reservoir 106.

Figure 3:
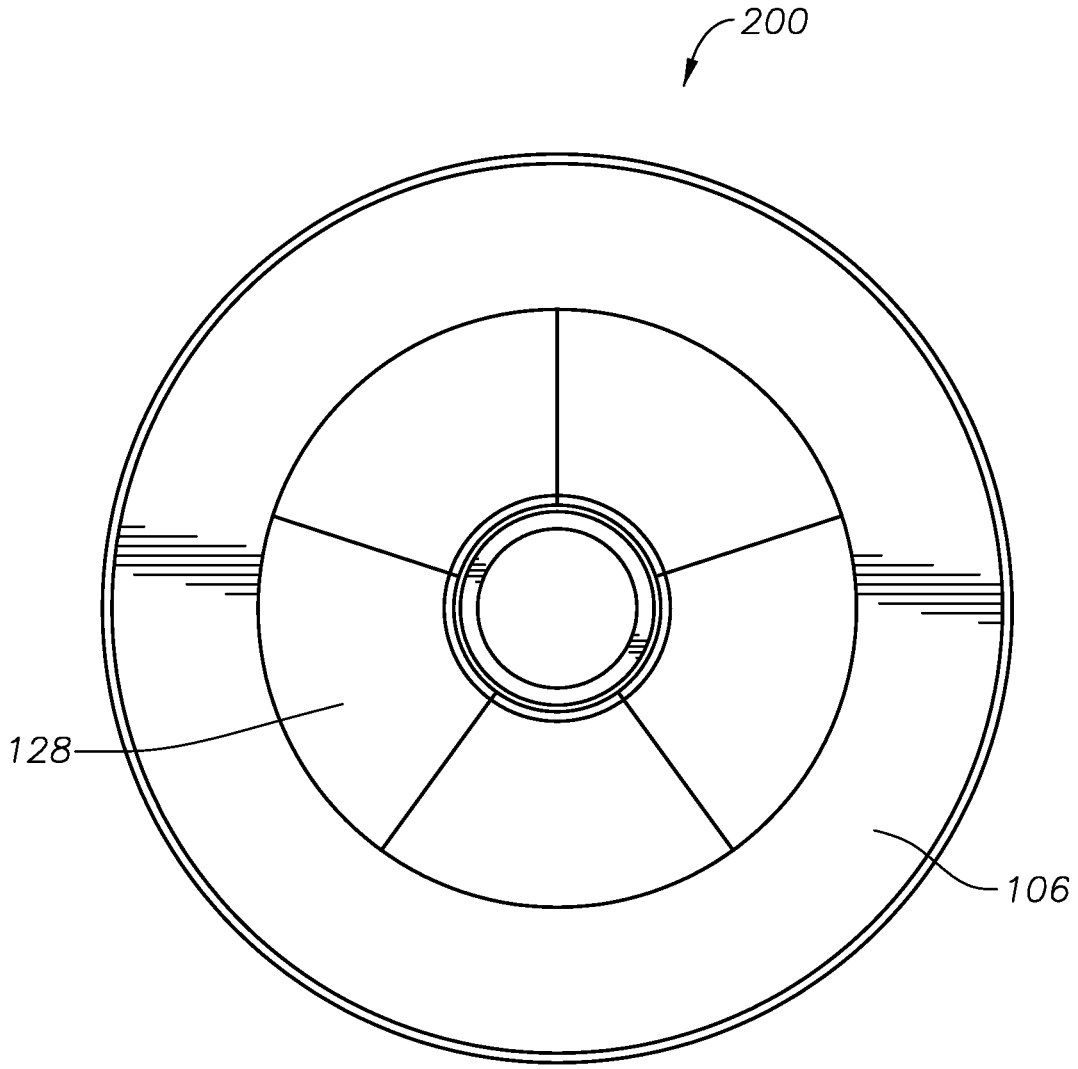
FIG. 3 is a top view of a wellhead spill prevention apparatus, according to one or more example embodiments of the disclosure.

FIG. 3 illustrates a top view of an alternate embodiment of the wellhead spill prevention apparatus 200. In this embodiment, the slanted wall 108 may include a plurality of panels 128 adjoining each other, thereby forming a generally frusto-conical structure having a first diameter and a second diameter, the second diameter being larger than the first diameter. When a wellhead pressure is bled off or when a wireline or slickline job is completed, and the lubricator is disconnected from the well, oil spills from the lubricator or the wellhead frequently take place. This spill is harmful to the environment, and costs time and money to remove it. With reference to FIG. 3, in either embodiment, where the passageway is circular or polygonal, a gap or annular space may be formed between the interior sidewalls of the passageway and the oil well tubular member 104. In such cases, it is possible that some of the waste fluids from the wellhead could flow down the oil well tubular member and flow through the annular space, bypassing the oil catch pan.

One embodiment of the invention is an external clamp-on round tray (container) like a drip pan that surrounds the wellhead, which prevents the spill to seep into the wellhead and valves, containing crude oil coming out of the wellhead. The clamp-on tray provides the flexibility to be installed on any size of wellhead without the need of any fabrication or compromise to the integrity and design. The installed container can then be drained in an environmental friendly manner without any spills in the area.

The clamp-on tray is designed for well intervention operation when the lubricator is disconnected from the crown valve (top valve in the Christmas tree). The clamp-on tray collects and prevents spills from the top (first gate valve to the well) and prevents oils from seeping into the rest of the wellhead body and can be easily removed. Prior art trays are designed either to only protect the soil around a well head or they are utilized for specific type of wellhead, e.g. a push rod wellhead only.

An additional problem encountered during the operating of a reciprocating pumping device or 'pumpjack' system is the frictional wear and associated fluid leakage at the stuffing box. Generally, the stuffing box is positioned on top of the wellhead and surrounds the polish rod to provide a fluid tight seal to prevent fluid leaking. Over time the seal within the stuffing box wears and loses its effectiveness with the resultant loss of liquid from the well.

Such leakage may initially be of a small volume and continue for an extended period of time until the increase in leakage volume warrants maintenance of the stuffing box. This leakage unless contained, can eventually result in a substantial volume being spilled from the wellhead. As a result there is an expense associated with cleaning and maintaining the wellhead in a safe working condition and a further expense associated with required environmental site cleanup through the disposal of the surrounding contaminated soil.

The primary leak containment device of the present invention is simple to use and easy to install and requires little or no maintenance. The device may be installed on a wellhead at the time of pumping commencement and may be left in place for the duration of production thereby preventing any quantity of liquid escaping from the stuffing box fouling the wellhead or surrounding soil.

Accordingly, one embodiment is an oil catch pan, or in combination with a tubular member of a wellhead, is provided in several sections. Each section abuts to an adjacent section, so that together they form an annular pan. Each section forms a fluid-containing basin defined by a bottom, an interior sidewall, an exterior sidewall and end sidewalls. End sidewalls of adjacent sections form abutments. The interior sidewalls of the annular pan form a passageway for passage of the tubular member. The pan can be supported upon a flange. The interior walls of the pan can be press fit onto a flange. One or more couplers link adjacent sections, arranged at their abutments, to form the annular pan.

In one embodiment, the inner annulus of the assembly is sized to accommodate a relatively large pipe casing, bop flange or other component and inserts which are preferably comprised of a ultra-high molecular weight (UHMW) plastic or other suitable material are placed between the inner annular edge and the pipe casing or other component in order to accommodate components of different sizes giving the tray assembly a universal fit. In this embodiment, the UHMW plastic insert is comprised of two halves or parts which may be inserted in place around the pipe casing, although other configurations of these components would be obvious to a person of skill in the art. In the illustrated embodiment, the plastic insert comprises two semi-circular units, each unit further comprising an upper and lower semi-annular plate to which seals such as o-ring materials which are resistant to hydrocarbons are attached. The upper and lower halves of the illustrated insert unit are held in approximation to each other by the use of nuts and bolts which pass through the upper and lower units and through multiple inserts which maintain the distance separation between the upper and lower halves uniting to form a bushing-like spacer between the inner annular surface of the bop tray and the outer surface of the wellhead stem.

Many alternatives, variations, substitutions, equivalents and the like will be evident for varied applications of the teachings of the present invention. For instance, it is possible that analogous uses and benefits may be appreciated irrespective whether bop tray 100 is positioned directly on the wellhead pipe stem or elsewhere. It is also possible that analogous uses and benefits may be appreciated irrespective whether bop tray 100 or other aspects of the invention are used around the wellhead pipe stem of drilling rigs or service rigs or, for that matter, transport barges or other applications. Accordingly, to the extent structures or methods are captured within the spirit of the claims and their equivalents, the invention should not be limited by the foregoing descriptions. Additionally, the bop tray may include an opening (not shown) as a drain fitting to attach a hose to the bottom for fluid to run off into a container.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Conditional language, such as, among others, "can," "could," "might," or "may," unless specifically stated otherwise, or otherwise understood within the context as used, is generally intended to convey that certain implementations could include, while other implementations do not include, certain features, elements or operations. Thus, such conditional language generally is not intended to imply that features, elements or operations are in any way required for one or more implementations or that one or more implementations necessarily include logic for deciding, with or without user input or prompting, whether these features, elements or operations are included or are to be performed in any particular implementation.

The systems and methods described, therefore, are well adapted to carry out the objects and attain the ends and advantages mentioned, as well as others that may be inherent. While example embodiments of the system and method has been given for purposes of disclosure, numerous changes exist in the details of procedures for accomplishing the desired results. These and other similar modifications may readily suggest themselves to those skilled in the art, and are intended to be encompassed within the spirit of the system and method disclosed and the scope of the appended claims.

The invention claimed is:

1. A wellhead spill prevention apparatus comprising:

a clamp-on portion that is configured to be clamped onto a tubular member of the wellhead, the wellhead having a crown valve and a flange disposed above the crown valve;

a crude oil reservoir for collecting oil coming from the wellhead and that comprises an annular pan having a sidewall and a floor that is supported on the flange; and a slanted wall slanting downwards and attached to the clamp-on portion on top and the crude oil reservoir at the bottom, thereby enabling oil coming from the wellhead to collect in the crude oil reservoir, wherein the clamp-on portion, the crude oil reservoir, and the slanted wall each comprise a material selected from the group consisting of stainless steel, aluminum, and reinforced rubber material, wherein the slanted wall comprises a plurality of separate and distinct panels adjoining each other that do not overlap with one another, thereby forming a generally frusto-conical structure having a first diameter and a second diameter, the second diameter being larger than the first diameter.

2. The apparatus of claim 1, wherein the slanted wall has a frusto-conical structure having a first diameter and a second diameter, the second diameter being larger than the first diameter.

3. The apparatus of claim 1, wherein interior walls of the pan are press fit onto the flange.

4. The apparatus of claim 1, further comprising two or more segments, each comprising a portion of the clamp-on portion, the crude oil reservoir, and the slanted wall.

5. The apparatus of claim 4, wherein the two or more segments are held together by means of two or more couplers.

6. The apparatus of claim 5, wherein the two or more couplers each comprise a pin inserted into an eyelet formed on each of the segments.

7. The apparatus of claim 5, wherein the two or more couplers are installed on the body of the apparatus so as to couple the two or more segments together.

8. The apparatus of claim 1, wherein the clamp-on portion is configured to be clamped onto a portion of the wellhead when a lubricator is disconnected from a crown valve of the wellhead assembly.

9. The apparatus of claim 1, wherein the clamp-on portion is configured to be clamped onto a portion of the wellhead when a wellhead pressure is bled off or when a wireline or slickline job is completed.

10. The apparatus of claim 1, wherein the crude oil reservoir comprises an annular pan or tray having a floor, a side wall, and a generally circular shape.

11. The apparatus of claim 10, wherein the side wall is either vertical or formed at an angle relative to the floor of the tray.

12. The apparatus of claim 1, wherein the clamp-on portion, the crude oil reservoir, and the slanted wall are made of the same material.

13. The apparatus of claim 1, wherein the clamp-on portion, the crude oil reservoir, and the slanted wall are made of different materials.

14. The apparatus of claim 1, wherein the clamp-on portion, the crude oil reservoir, and the slanted wall each comprise a light weight material.

15. A method for wellhead spill prevention, the method comprising:

clamping on a spill prevention apparatus to a tubular member of the wellhead that has a crown valve and a flange disposed above the crown valve, the spill prevention apparatus comprising:

a clamp-on portion that is configured to be clamped onto the tubular member of the wellhead;

a crude oil reservoir for collecting oil coming from the wellhead and that comprises an annular pan having a sidewall and a floor that is supported on the flange; and a slanted wall slanting downwards and attached to the clamp-on portion on top and the crude oil reservoir at the bottom, thereby enabling oil coming from the wellhead to collect in the crude oil reservoir, wherein the clamp-on portion, the crude oil reservoir, and the slanted wall each comprise a material selected from the group consisting of stainless steel, aluminum, and reinforced rubber material, wherein the slanted wall comprises a plurality of separate and distinct panels adjoining each other that do not overlap with one another, thereby forming a generally frusto-conical structure having a first diameter and a second diameter, the second diameter being larger than the first diameter.

16. The method of claim 15, wherein the slanted wall has a frusto-conical structure having a first diameter and a second diameter, the second diameter being larger than the first diameter.

17. The method of claim 15, wherein the spill prevention apparatus comprises two or more segments, each comprising a portion of the clamp-on portion, the crude oil reservoir, and the slanted wall.

18. The method of claim 17, wherein the two or more segments are held together by means of two or more couplers.

* * * * *